United States Patent [19]

Valentine et al.

[11] 4,372,144

[45] Feb. 8, 1983

[54] WRAP RING ASSEMBLY FOR PRECISION NO-DRAFT FORGING

[76] Inventors: John J. Valentine, 1518 E. McWood St., West Covina, Calif. 91791; Julius J. Fera, 17796 Fairview Dr., Fontana, Calif. 92335

[21] Appl. No.: 257,894

[22] Filed: Apr. 27, 1981

[51] Int. Cl.[3] ..... B21D 22/00

[52] U.S. Cl. ..... 72/352

[58] Field of Search ..... 72/352, 354, 358, 360

[56] References Cited

U.S. PATENT DOCUMENTS

| | | | |
|---|---|---|---|
| 3,197,996 | 8/1965 | Zeder, Jr. | 72/354 |
| 3,537,291 | 11/1970 | Hawkins | 72/352 X |
| 3,869,776 | 3/1975 | Moshnin et al. | 72/358 X |
| 4,074,359 | 2/1978 | Beane et al. | 72/354 |
| 4,150,557 | 4/1979 | Walker et al. | 72/354 |
| 4,265,105 | 5/1981 | MacNitt et al. | 72/354 |

*Primary Examiner*—Leon Gilden

*Attorney, Agent, or Firm*—Boniard I. Brown

[57] ABSTRACT

A wrap ring assembly for cooperation with an associated forging press which includes a punch having a first cavity and means for moving the punch up and down which includes a punch holder. The apparatus includes a wrap ring having a bore therein and means for carrying the wrap ring on the punch holder which allows relative motion therebetween and which includes biasing means for urging the punch holder and the wrap ring apart. A wrap die is dimensioned for cooperation with the punch and has an exterior surface dimensioned for cooperation with the bore of the wrap ring. The apparatus may further include means for gripping the wrap ring and urging the wrap ring away from the punch holder. The apparatus may further include means for heating the wrap ring at least before the initiation of forging operations.

9 Claims, 4 Drawing Figures

WRAP RING ASSEMBLY FOR PRECISION NO-DRAFT FORGING

BACKGROUND OF THE INVENTION

The invention relates to forging apparatus and particularly to apparatus for use with an associated forging press in a no-draft forging process. No-draft forging processes, also referred to as seamless forging processes, are particularly desirable for forging parts having small dimensional tolerances in which it is desired to avoid the presence of a seam as in other forging processes.

Seamless forging has been traditionally accomplished on very expensive forging presses. Such presses are typically manufactured only on special order and are delivered typically two or three years after placement of an order.

The cost, size and delivery limitations of such presses are significant problems in attempting to use a seamless forging process.

It is an object of the invention to provide apparatus which will enable the utilization of the seamless forging process without requiring the utilization of presses of the size and type previously required for such processes.

It is another object of the invention to provide apparatus which will enable the utilization of the seamless forging process on existing presses which were not originally capable of such forging operations.

It is another object of the invention to provide apparatus which is relatively inexpensive to manufacture and which may easily be utilized.

SUMMARY OF THE INVENTION

The foregoing objects and other objects and advantages which shall become apparent from the detailed description of the preferred embodiment are attained in a wrap ring assembly for cooperation with an associated forging press which includes a punch having a first cavity and means for moving the punch up and down which includes a punch holder. The apparatus includes a wrap ring having a bore therein and means for carrying the wrap ring on the punch holder which allows relative motion therebetween and which includes biasing means for urging the punch holder and the wrap ring apart. A wrap die is dimensioned for cooperation with the punch and has an exterior surface dimensioned for cooperation with the bore of the wrap ring.

The apparatus may further include means for gripping the wrap ring and urging the wrap ring away from the punch holder.

The apparatus may further include means for heating the wrap ring, at least before the initiation of forging operations.

The apparatus may also includes means for initiating engagement of the means for gripping responsive to downward motion of the punch holder.

The apparatus may further include means for initiating engagement of the means for gripping responsive to downward motion of the punch holder and means for terminating engagement of the means for gripping which is responsive to movement of the punch holder downwardly. The biasing means may include at least one spring. The means for initiating may include at least one hydraulic cylinder and the means for terminating may include at least one hydraulic cylinder. The biasing means may include at least one shaft disposed intermediate the punch holder and the wrap ring and carrying a coil spring thereon, the shaft being mounted to allow relative axial movement with respect to either the punch holder or the wrap ring.

BRIEF DESCRIPTION OF THE ACCOMPANYING DRAWING

DESCRIPTION OF THE PREFERRED EMBODIMENT

Figure 1:
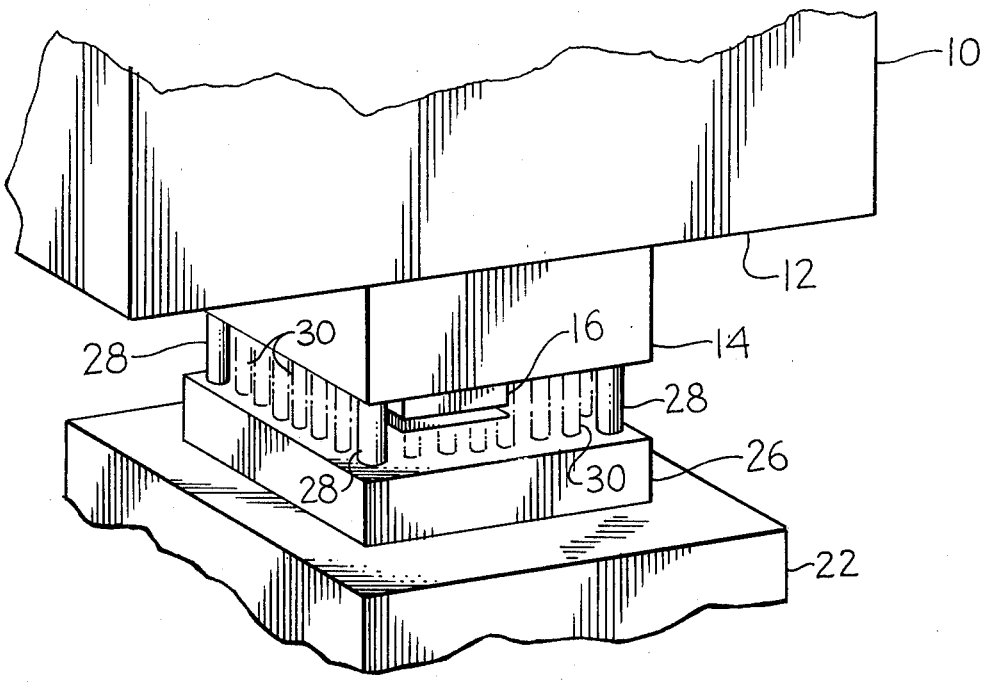
FIG. 1 is a broken away elevational view of the apparatus in accordance with the invention installed on an associated forging press.
Figure 3:
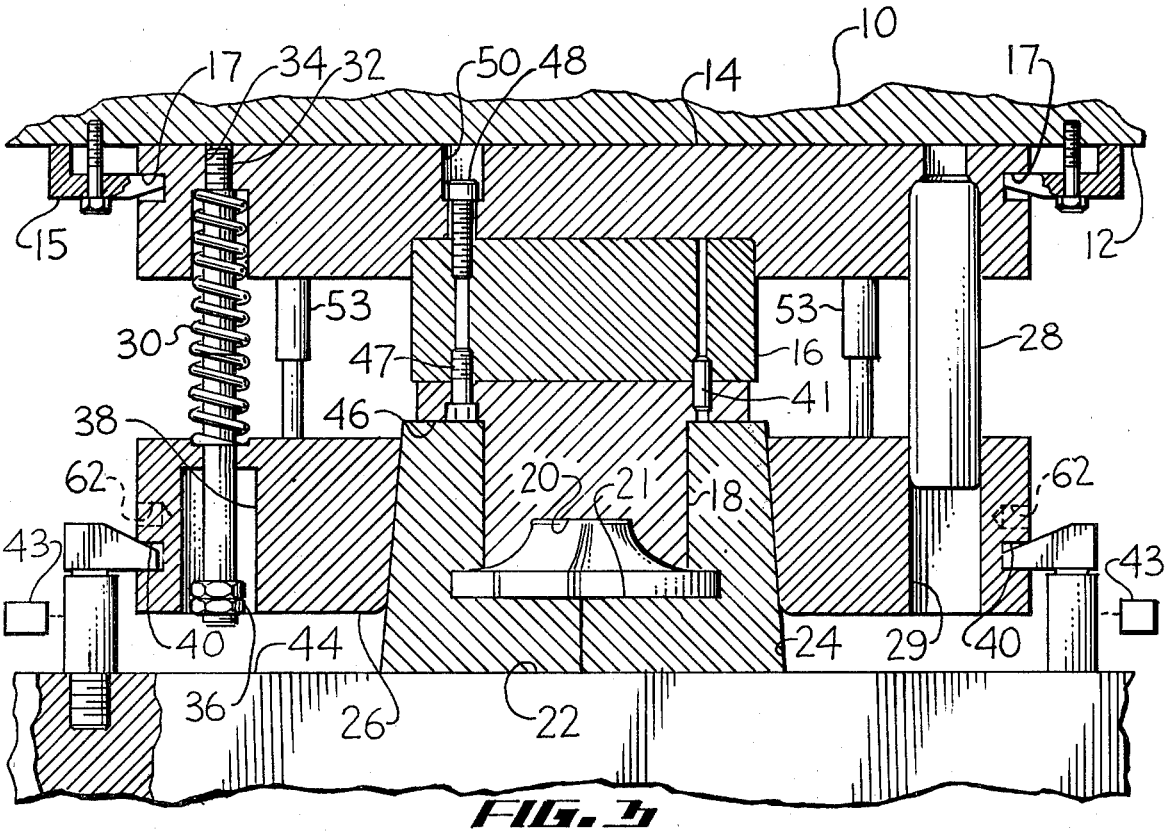
FIG. 3 is a partially schematic sectional view taken along the line 3—3 of FIG. 2.
Figure 2:
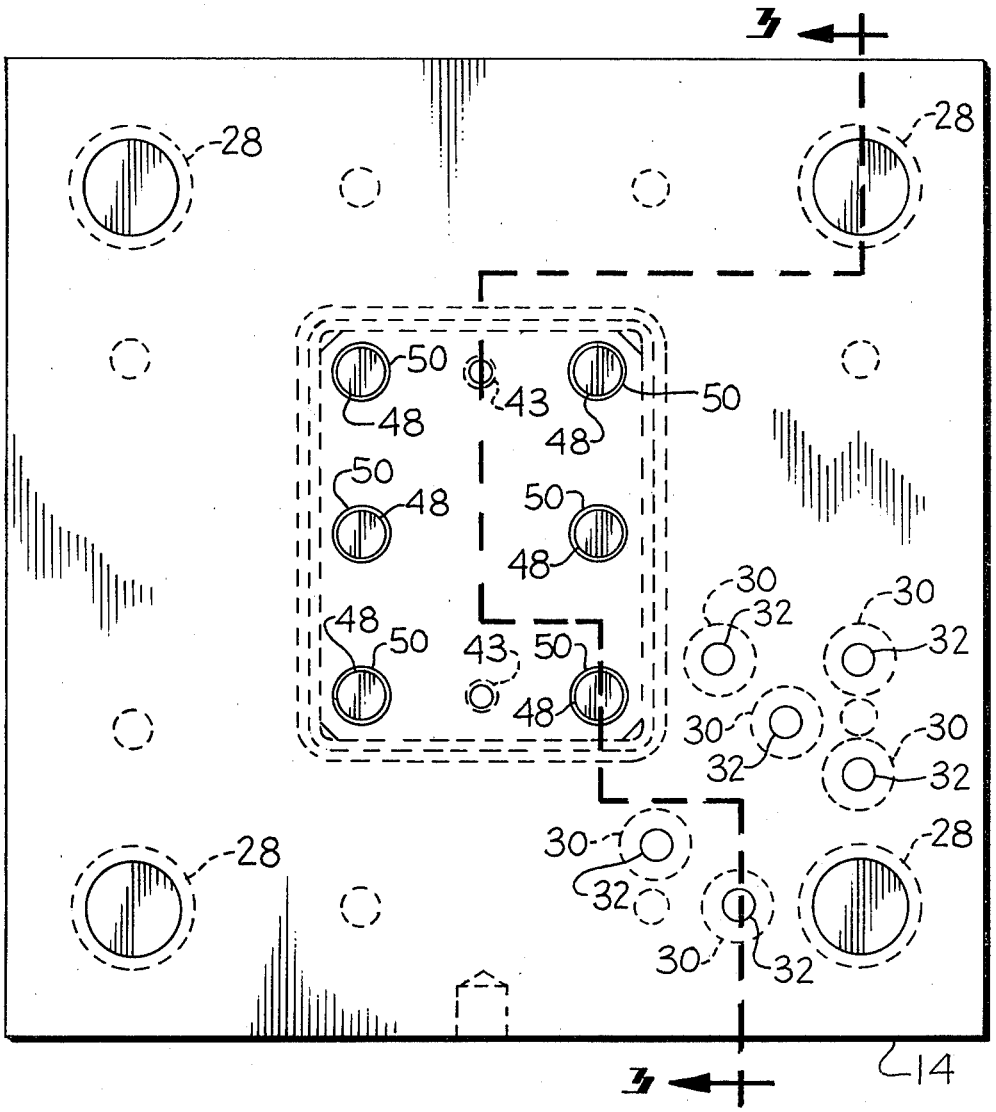
FIG. 2 is a plan view of the apparatus in accordance with the invention illustrated in FIG. 1 and more specifically is a view looking down at the top of the punch holder beneath which is disposed the punch spacer block, punch wrap ring, wrap die, and bolster.

The invention will be better understood by referring now to FIGS. 1, 2, and 3. It will be understood that the apparatus in accordance with the invention is particularly suitable for use in the so-called standard hydraulic presses which are manufactured by a wide variety of companies. Such presses typically have a capacity of 500 tons and larger.

Mounted on the upper ram 10 of the associated forging press is a punch or top holder 14 which carries a punch spacer 16. The punch holder 14 is mounted on the upper ram 10 by clamps 15. The punch holder 14 in turn carries a punch spacer block 16. The punch spacer block 16 carries the punch 18 which is provided with a cavity 20 for forming a workpiece 21. The workpiece 21 is also formed by the cavity 22 disposed in the wrap die 24 which cooperates with the wrap ring 26.

The alignment between the punch holder 14 and the wrap ring 26 is maintained during relative vertical motion by guide pins 28 disposed at each of the four corners of the generally square wrap ring 26 of the generally square punch holder 14. The guide pins 28 each engage a bore 29 in the wrap ring 26.

A plurality of springs 30 are carried on studs 32 disposed in threaded bores 34 in the punch holder 14. Two nuts 36 engage the lower extremity of each stud 32 and are disposed within a recess 38 in the wrap ring 26. The wrap ring 26 is provided with a plurality of recesses 40 which are engaged by hydraulically operated swing clamps 42 to position the wrap ring 26 vertically relative to the bolster 44. It will be understood that the hydraulically operated swing clamps 42 are mounted on the bolster 44.

The mounting of the punch 18 on the punch spacer block 16 is accomplished by dowel pins 41 and securing bolts 47 which are recessed in a step 46 of the punch 18 and which engage a threaded bore in the punch spacer block 16. The punch spacer block 16 is secured to the punch holder 14 by a plurality of bolts 48 which are each disposed in a counterbore 50 in the punch holder 14. The bolts 48 each engage a threaded bore in the punch spacer block 16.

In operation the ram 10 urges the punch 18 downward into the wrap die 24 and simultaneously urges the wrap ring 26 downward. The springs 30 (which typically have a free length of about two feet and a compressed length of about sixteen inches) are compressed during this process to provide additional force to hold the wrap ring 26 downward and thus about both the punch 18 and the wrap die 24. The force produced by the springs 30 may in a typical embodiment produce a total force of about 59 tons. The hydraulic swing clamps 42 are automatically swung into engagement with the recesses 40 to provide substantial additional force. Such hydraulic swing clamps 42 may be of various capacities. Typical capacities which have been found to be desirable range from one to three tons for each clamp, although other capacities may be quite suitable for other applications. At the bottom of the stroke of the ram 10 the punch 18 will bottom against the wrap die 24 and apparatus 43, shown schematically, is provided for automatically disengaging the hydraulic swing clamp 43 from the recesses 40 of the wrap die 26. The apparatus 43 may be controlled by switches (not shown) which control valves (not shown) to direct pressurized fluids to move the swing clamp 42 responsive to movement of the ram 10. In the preferred form the hydraulically operated swing clamps 42 do not move the wrap ring 26 lower than a position which results in a minimum vertical spacing of three inches between the wrap ring 26 and the bolster 44. This minimum spacing is necessary to provide clearance for the studs 32 and nuts 36 as the vertical distance between the wrap ring 26 and the top holder 14 decreases.

For those application which require relatively heavy loads, hydraulic cylinders 53, shown in FIG. 3, may be utilized. These cylinders 53 include a cylinder fixed at the upper axial extremity to the punch holder 14 and a rod fixed to the piston (not shown) thereof which is connected by a screw thread connection to the wrap ring 26. Such hydraulic cylinders 53 may apply all of the load required or may be utilized in conjunction with the springs 30 and/or the swing clamps 42. The cylinders 53 are used in a symetrical arrangement. Typically eight of them may be utilized without any springs 30 or swing clamps 42. Such embodiments may use sixteen studs 32 and thirty two nuts 36 with two studs on each side of each guide pin 28.

Such hold-down loads are needed where a relatively wide cavity or "impression" is used, wherein the cavity extends laterally beyond the punch and has a large cross-sectional area. The metal being formed "pushes back" or exerts "back pressure" when, for example, aluminum is being formed. Without sufficient hold-down load, this back pressure would unseat the wrap die 24 and push the wrap ring 26 up. In addition the swing clamps 42 would also be damaged. Typically, at 20 tons per square inch, with a cavity cross-sectional area of 6 inches by 4 inches, 24 sq. inches, 480 tons of back pressur would be exerted.

The punch holder 14 is provided with recesses 17 for engagement by lifting apparatus. Similarly the wrap ring 26 is provided with recesses 62 for lifting the wrap ring 26.

Figure 4:
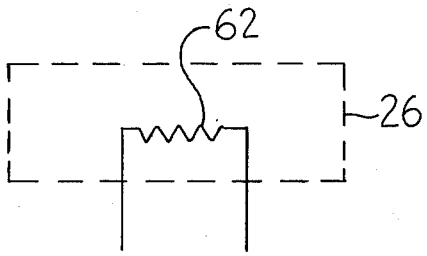
FIG. 4 is a schematic view illustrating the resistance heater provided in the wrap ring.

Illustrated schematically in FIG. 4 are electrical resistance heaters 62 which are disposed in openings (not shown) in the wrap ring 26. Ordinarily the temperature of the wrap ring prior to the start of operations is maintained thermostatically within the range of 400 to 800 degrees F. After forging operations have begun the wrap die will absorb heat from the aluminum or other material which is being forged, in part due to friction. In some embodiments gas heating may be utilized to heat the wrap ring 26 and the wrap die 24.

The opening in the wrap ring 26 which cooperates with the wrap die 24, may in a typical installation, be approximately 14 by 18 inches with a three degree draft angle. The wrap die 24 may be manufactured in two or more segments to allow the operator to take the segments apart and remove the forging produced by the process. In such instances no draft whatsoever is necessary between die segments.

It will be understood that the apparatus in accordance with the invention cooperates with a conventional forging press to enable it to function in a manner which is not ordinarily possible without the use of much more specialized equipment which might have an initial cost of as much as $1,000,000 more.

The invention has been described with reference to its illustrated preferred embodiment. Persons skilled in the art of constructing no-draft forging assemblies may, upon exposure to the teachings herein, conceive variations in the mechanical development of the components therein. One such variation is the substitution of a horizontal or other orientation of the apparatus for the vertical orientation described herein. Such variations are deemed to be encompassed by the disclosure, the invention being delimited only by the appended claims.

The inventor claims:

1. A wrap ring assembly for cooperation with an associated forging press which comprises:

a punch having a first cavity;

means for moving said punch up and down which includes a punch holder;

a wrap ring having a bore therein;

means for carrying said wrap ring on said punch holder which allows relative motion therebetween and which includes biasing means for urging said punch holder and said wrap ring apart; and a wrap die dimensioned for cooperation with said punch and having an exterior surface dimensioned for cooperation with said bore of said wrap ring.

2. The apparatus as described in claim 1, wherein:

said apparatus further includes means for gripping said wrap ring and urging said wrap ring away from said punch holder.

3. The apparatus as described in claim 1 or 2, wherein:

said apparatus further includes means for heating said wrap ring, at least before the initiation of forging operations.

4. The apparatus as described in claim 1 or 2, wherein:

said apparatus further includes means for initiating engagement of said means for gripping responsive to downward motion of said punch holder.

5. The apparatus as described in claim 1 or 2, wherein:

said apparatus further includes means for initiating engagement of said means for gripping responsive to downward motion of said punch holder and means for terminating engagement of said means for gripping which is responsive to movement of said punch holder downwardly.

6. The apparatus as described in claim 1, wherein:

said biasing means includes at least one spring.

7. The apparatus as described in claim 4, wherein:

said means for initiating includes at least one hydraulic cylinder.

8. The apparatus as described in claim 5, wherein:

said means for initiating includes at least one hydraulic cylinder and said means for terminating includes at least one hydraulic cylinder.

9. The apparatus as described in claim 1, wherein:

said biasing means includes at least one shaft disposed intermediate said punch holder and said wrap ring and carrying a coil spring thereon, said shaft being mounted to allow relative axial movement with respect to either said punch holder or said wrap ring.

* * * * *